US008643683B2

(12) United States Patent
Chang

(10) Patent No.: US 8,643,683 B2
(45) Date of Patent: Feb. 4, 2014

(54) DRIVER OF FIELD SEQUENTIAL DISPLAY CAPABLE OF SWITCHING CURRENT AND VOLTAGE OF SCAN SIGNAL AND DISPLAY SIGNAL AND DRIVING METHOD THEREOF

(75) Inventor: Pao-Shu Chang, Hsinchu (TW)

(73) Assignee: Nuvoton Technolgoy Corporation, Hinschu (TW)

( * ) Notice: Subject to any disclaimer, the term of this patent is extended or adjusted under 35 U.S.C. 154(b) by 880 days.

(21) Appl. No.: 12/824,238

(22) Filed: Jun. 28, 2010

(65) Prior Publication Data

US 2011/0102476 A1 May 5, 2011

(30) Foreign Application Priority Data

Nov. 3, 2009 (TW) ..... 98137310 A

(51) Int. Cl.
*G09G 5/10* (2006.01)

(52) U.S. Cl.
USPC ..... 345/690; 345/88

(58) Field of Classification Search
USPC ..... 345/211–213, 99, 100, 87, 88, 52; 315/169.1–169.4
See application file for complete search history.

(56) References Cited

U.S. PATENT DOCUMENTS

| | | | | |
|---|---|---|---|---|
| 5,844,538 | A * | 12/1998 | Shiraki et al. | 345/98 |
| 6,092,207 | A | 7/2000 | Kolinski et al. | |
| 6,756,976 | B2 | 6/2004 | Richards | |
| 7,002,569 | B1 * | 2/2006 | Gettemy et al. | 345/211 |
| 7,102,632 | B2 * | 9/2006 | Siwinski | 345/212 |
| 7,944,423 | B2 * | 5/2011 | Kurumisawa | 345/88 |
| 2002/0036636 | A1 * | 3/2002 | Yanagi et al. | 345/211 |
| 2003/0117355 | A1 | 6/2003 | Yamauchi | |
| 2008/0024480 | A1 * | 1/2008 | Jee et al. | 345/212 |

FOREIGN PATENT DOCUMENTS

| | | |
|---|---|---|
| CN | 201278068 | 7/2009 |
| EP | 1603108 | 12/2005 |
| JP | 2003248463 | 9/2003 |
| KR | 10-20050008331 | 1/2005 |
| TW | 200643869 | 12/2006 |

OTHER PUBLICATIONS

"Office Action of Taiwan Counterpart Application", issued on Apr. 22, 2013, p. 1-p. 7, in which the listed references were cited.

* cited by examiner

*Primary Examiner* — Chanh Nguyen
*Assistant Examiner* — Ram Mistry
(74) *Attorney, Agent, or Firm* — Jianq Chyun IP Office

(57) ABSTRACT

A driver of a field sequential display is provided. The driver includes a first power device, a second power device, and a driving waveform generator. The first power device generates a first power when the field sequential display is in a color mode. The second power device generates a second power when the field sequential display is in a monochrome mode. The voltage and current of the second power are respectively smaller than the voltage and the current of the first power. The driving waveform generator coupled to the first power device and the second power device and generates a plurality of scan signals and a plurality of display signals according to the first power or the second power, so as to drive a display panel of the field sequential display.

9 Claims, 4 Drawing Sheets

DRIVER OF FIELD SEQUENTIAL DISPLAY CAPABLE OF SWITCHING CURRENT AND VOLTAGE OF SCAN SIGNAL AND DISPLAY SIGNAL AND DRIVING METHOD THEREOF

CROSS-REFERENCE TO RELATED APPLICATION

This application claims the priority benefit of Taiwan application serial no. 98137310, filed on Nov. 3, 2009. The entirety of the above-mentioned patent application is hereby incorporated by reference herein and made a part of specification.

BACKGROUND OF THE INVENTION

1. Field of the Invention

The present invention generally relates to a driver, and more particularly, to a driver of a field sequential display and a driving method thereof.

2. Description of Related Art

The backlight module of a conventional liquid crystal display (LCD) is usually designed with a white light source (usually emitted by a Cold cathode fluorescent lamp (CCFL)), and the white light source provides a backlight for each pixel through color filters. A red, a green, and a blue color filters are disposed above each pixel in the pixel array. Such a design increases the fabricating cost, and color mixing problem may be occurred between the red, green, and blue color filters. Besides, since color filters are disposed in a LCD, the light generated from the white light source is blocked by the color filters and accordingly the brightness of the LCD is reduced.

To resolve aforementioned problems, a color sequential display is developed based on a color sequential technique and a control circuit. In such a display, color fields are alternatively displayed. Accordingly, a color sequential display is also referred to as a field sequential display. In a field sequential display, light-emitting diodes (LEDs) of different colors are adopted to replace the conventional white light source, and the LEDs of different colors are alternatively lit at different time so that different colors can be displayed at different pixels. The theory of field sequential display is to rapidly alternate between red, blue and green images in succession within the time range of visual persistence of human eyes, so as to produce a color mixing effect and allow the human eyes to see full-color images.

Because the working principle of field sequential display is similar to that of super twisted nematic (STN) LCD, a field sequential display can display monochromatic images as a STN LCD if the LEDs of the field sequential display are not driven. Thus, when a field sequential display is in a color mode, the LEDs corresponding to one of the colors are sequentially lit so as to display color images, and when the field sequential display is in a monochrome mode, the LEDs thereof are turned off so that monochromatic images are displayed.

FIG. 1 illustrates a driving waveform of a conventional field sequential display in the color mode. Referring to FIG. 1, in the color mode, a frame period is divided into a red field, a green field, and a blue field display period, and the driving signals COM0~COM31 respectively produce two pulses during the display period of each color field and are sent to scan lines in a display panel to drive the pixels of the display panel. Besides, corresponding LEDs are driven to display the corresponding color during the display period of each color field. FIG. 2 illustrates a driving waveform of a conventional field sequential display in the monochrome mode. Referring to FIG. 2, in the monochrome mode, the frame period is not divided, while the driving signals COM0~COM31 respectively form two pulses during the frame period and are sent to scan lines of a display panel to drive the pixels of the display panel.

As described above, when the field sequential display is in the color mode, because the frame period is divided, the driving time of each scan line (i.e., the pulse period) is shorter. In order to prevent the effective driving time from being shortened, the pulse rising and falling time of the driving signals have to be reduced (i.e., the rising and falling rates have to be increased). Accordingly, a high current is necessary. Besides, in order to improve the display quality of the field sequential display, a high voltage has to be supplied in the field sequential display.

Contrarily, when the field sequential display is in the monochrome mode, because the frame period is not divided, the driving time of each scan line is longer than that in the color mode. Accordingly, the rising and falling time of the driving signals are longer than those in the color mode (means can adopt relatively low current in this model). Besides, in the monochrome mode, the display quality of the field sequential display is not that obvious and accordingly a relatively low voltage can be supplied in the field sequential display.

Generally speaking, only one power supply (or power device) is disposed in a field sequential display. Since a field sequential display is mostly in the color mode, the power supply is usually designed with a high voltage and a high current to meet the requirement of driving signals and displayed data in the color mode. Thus, when the field sequential display is in the monochrome mode, it is meaningless to generate the driving signals and displayed data by using a power with a high voltage and a high current, and power is consumed unnecessarily.

SUMMARY OF THE INVENTION

According to an embodiment of the present invention, a driver of a field sequential display is provided. The driver includes a first power device, a second power device, and a driving waveform generator. The first power device generates a first power when the field sequential display is in a color mode, and the second power device generates a second power when the field sequential display is in a monochrome mode, wherein the voltage and current of the second power are smaller than the voltage and current of the first power. The driving waveform generator is coupled to the first power device and the second power device and generates a plurality of scan signals and a plurality of display signals according to the first power or the second power, so as to drive a display panel of the field sequential display. The first power device and the second power device are enabled respectively when the field sequential display is in the color mode and the monochrome mode, according to a control signal.

According to an embodiment of the present invention, a driving method of a field sequential display is provided. The driving method includes following steps. First, whether the field sequential display is in a color mode or a monochrome mode is determined. A first power is generated if the field sequential display is in the color mode, and a second power is generated if the field sequential display is in the monochrome mode. Then, a plurality of scan signals and a plurality of display signals are generated according to the first power or the second power, so as to drive a display panel of the field sequential display. The voltage and current of the second power and smaller than the voltage and current of the first power.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
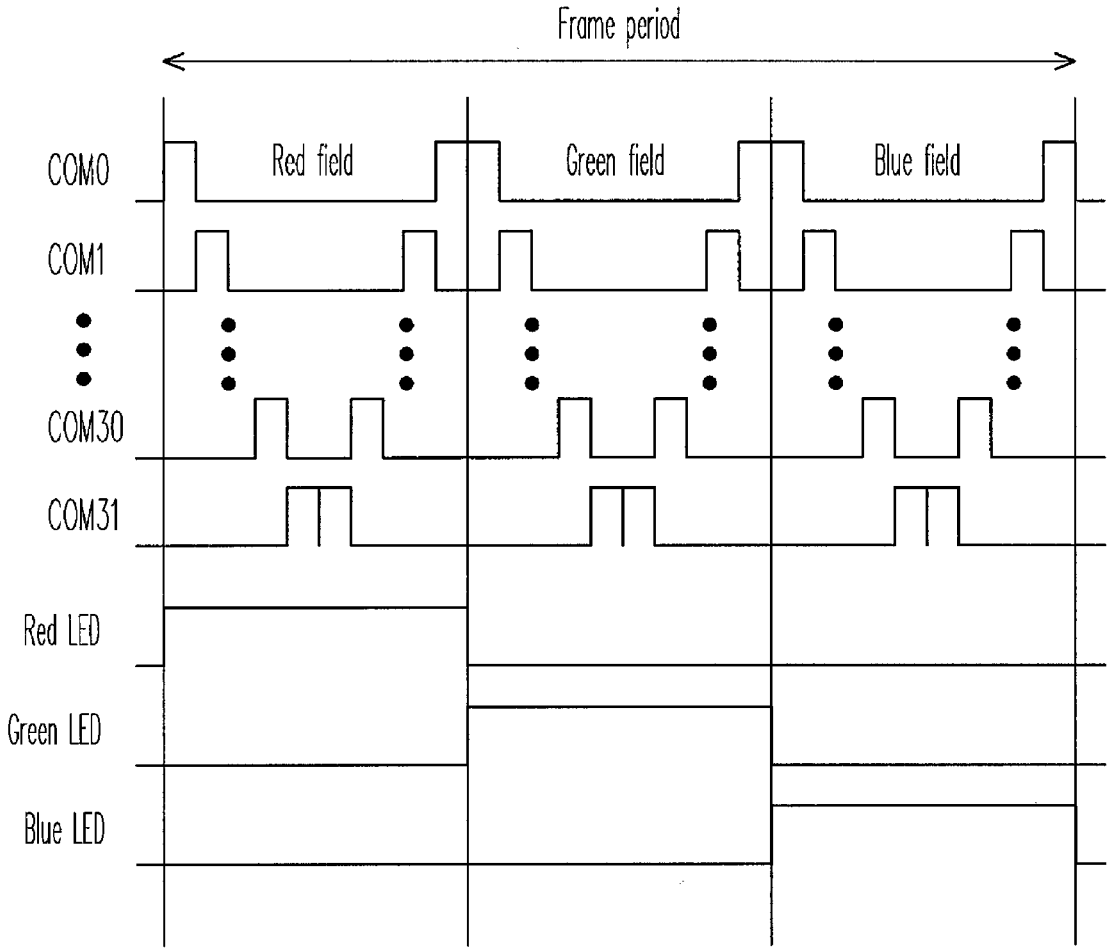
FIG. 1 illustrates a driving waveform of a conventional field sequential display in a color mode.

Reference will now be made in detail to the present embodiments of the invention, examples of which are illustrated in the accompanying drawings. Wherever possible, the same reference numbers are used in the drawings and the description to refer to the same or like parts.

A conventional field sequential display has only one power device that is designed to have a high voltage and a high current due to the requirement of a color mode. As a result, the power consumption of the conventional field sequential display cannot be reduced when the conventional field sequential display is in a monochrome mode. Accordingly, a driver of field sequential display with two power devices is provided in the present invention to resolve aforementioned problem. Embodiments of the present invention will be described below with reference to accompanying drawings.

Figure 3:
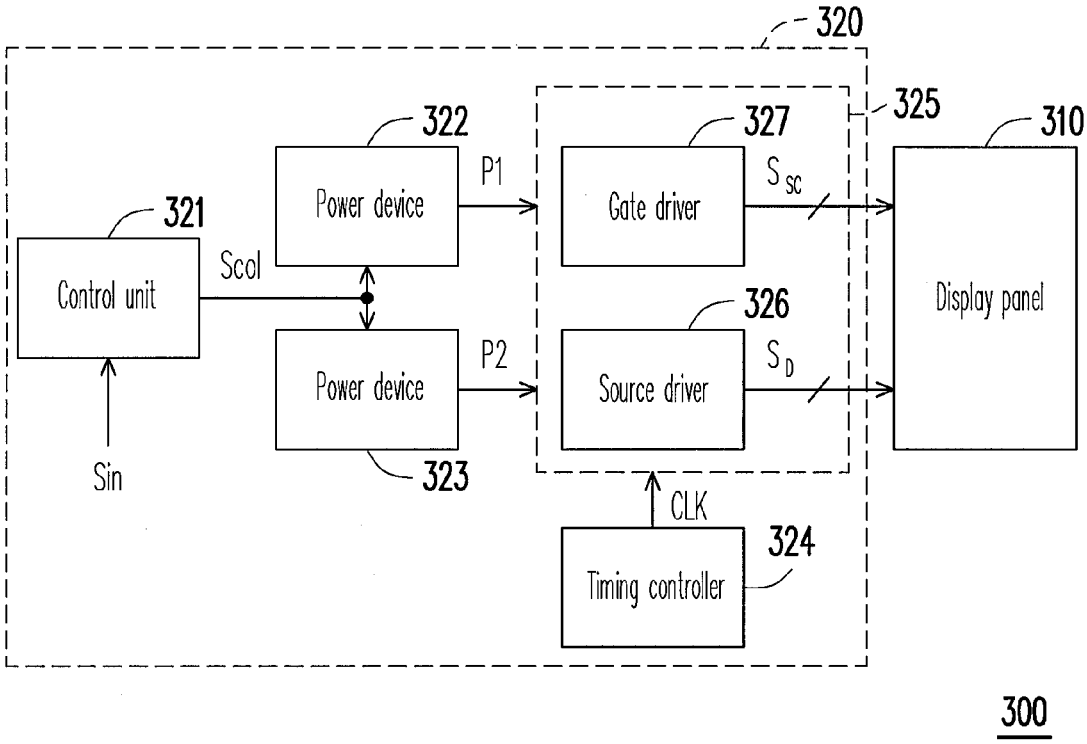
FIG. 3 is a diagram of a field sequential display according to an embodiment of the present invention.

FIG. 3 is a diagram of a field sequential display according to an embodiment of the present invention. Referring to FIG. 3, in the present embodiment, the field sequential display 300 includes a display panel 310 and a driver 320. The display panel 310 receives a plurality of scan signals $S_{SC}$ and a plurality of display signals $S_D$ from the driver, and is driven by the scan signals $S_{SC}$ and the display signals $S_D$ to display images. Each of the aforementioned display signals $S_D$ contains a plurality of display data to be written into pixels (not shown) of the display panel 310.

The driver 320 includes a control unit 321, power devices 322 and 323, a timing controller (TCON) 324, and a driving waveform generator 325. The control unit 321 can be a microcontroller. The power devices 322 and 323 can be power generators, power supplies, or other circuits or devices that can generate powers. To be specific, the power device 322 can be a voltage boost circuit for generating a power P1 with a high voltage and a high current, and the power device 323 can be a charge pump circuit for generating a power P2 with a low voltage and a low current. The terms high and low voltage (or current) as described herein should be considered as relative term rather than a specific standard of voltage or current.

The driving waveform generator 325 includes a gate driver 327 and a source driver 326. The gate driver 327 and the source driver 326 generate the scan signals $S_{SC}$ and the display signals $S_D$ according to a clock signal CLK generated by the TCON 324 and the power P1, or according to the clock signal CLK and the power P2.

When the field sequential display 300 is in the color mode, the control unit 321 generates a control signal Sco1 to enable the power device 322 and disable the power device 323. Herein the power P1 with the high voltage and high current is sent to the driving waveform generator 325, and the gate driver 327 and the source driver 326 respectively generate the scan signals $S_{SC}$ and the display signals $S_D$ according to the power P1 and the clock signal CLK. Herein the pulse of the scan signals $S_{SC}$ have a high rising/falling rate that can be referred to the driving signals COM0~COM31 illustrated in FIG. 1. Moreover, the maximum voltage of the display signals $S_D$ is higher. Besides, light emitting diodes (LEDs) are driven respectively in different color fields so that the display panel 310 can display color images.

Figure 2:
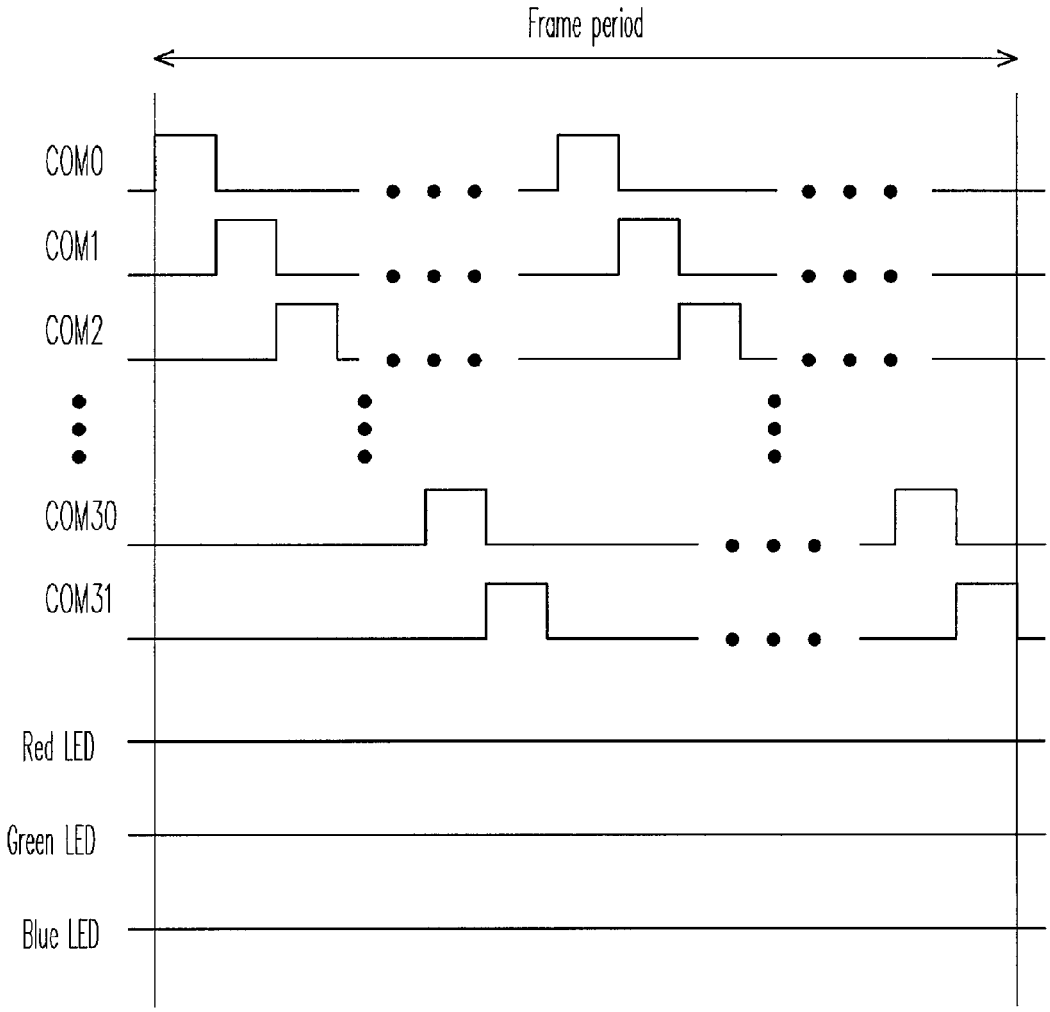
FIG. 2 illustrates a driving waveform of a conventional field sequential display in a monochrome mode.

When the field sequential display 300 is in the monochrome mode, the control unit 321 generates the control signal Sco1 to enable the power device 323 and disable the power device 322. The power P2 with the low voltage and low current is sent to the driving waveform generator 325, and the gate driver 327 and the source driver 326 respectively generate the scan signals $S_{SC}$ and the display signals $S_D$ according to the power P2 and the clock signal CLK. The pulses of the scan signals $S_{SC}$ have a low rising/falling rate that can be referred to the driving signals COM0~COM31 illustrated in FIG. 2. Moreover, the maximum voltage of the display signals $S_D$ is lower. Besides, LEDs (not shown) of the field sequential display 300 are not driven in the monochrome mode, and the display panel 310 displays monochromatic images by reflecting natural light. In addition, the LEDs of a monochromatic light source or all the LEDs can be lit at the same time to serve as a backlight source in the monochrome mode, so as to display monochromatic images at dark environment. Thereby, when the field sequential display 300 is in the monochrome mode, the scan signals $S_{SC}$ and the display signals $S_D$ are generated by using a power with a low voltage and a low current, so that the power consumption of the field sequential display 300 is reduced.

It should be mentioned that those having ordinary knowledge in the art can adjust the voltages and currents of the power P1 and the power P2 respectively generated by the power device 322 and the power device 323 according to the actual requirement. In other words, the voltages and currents of the power P1 and the power P2 vary along with the circuit design of the driver and the specification of the display panel and are not limited in embodiments of the present invention. Additionally, the period of the clock signal CLK generated by the TCON 324 in the monochrome mode can be greater than that of the clock signal CLK generated by the TCON 324 in the color mode.

In the present embodiment, the control signal Sco1 is generated by the control unit 321. However, the present invention is not limited thereto, and in other embodiments, the control signal Sco1 may also be inputted from an external circuit. In the present embodiment, the control signal Sco1 is generated according to an input signal Sin. The input signal Sin can be generated by an input device (not shown), and the input device may be a button or a touch panel. If the input signal Sin requests the field sequential display 300 to enter the color mode, the control unit 321 controls the TCON 324 and the driving waveform generator 325 according to the input signal Sin so as to switch the field sequential display 300 into the color mode, and the control unit 321 generates the control signal Sco1 to enable the power device 322 and disable the power device 323. If the input signal Sin requests the field sequential display 300 to enter the monochrome mode, the control unit 321 controls the TCON 324 and the driving waveform generator 325 according to the input signal Sin so as to switch the field sequential display 300 into the monochrome mode, and the control unit 321 generates the control signal Sco1 to enable the power device 323 and disable the power device 322. If the input signal Sin requests to turn off the field sequential display 300, the control unit 321 controls the TCON 324 and the driving waveform generator 325 according to the input signal Sin so as to turn off the field sequential display 300, and the control unit 321 generates the control signal Sco1 to disable the power devices 322 and 323.

The field sequential display 300 can also be applied in amusement equipment or toy. In this case, the control unit 321 generates the control signal Sco1 according to a unused time so as to switch the field sequential display 300 to the monochrome mode or turn off the field sequential display 300 when the field sequential display 300 is unused, so as to reduce the power consumption of the field sequential display 300. To be specific, assuming that the control unit 321 constantly receives the input signal Sin when the field sequential display 300 is operated, the control unit 321 controls the field sequential display 300 to be operated in the color mode and generates the control signal Sco1 to enable the power device 322 and disable the power device 323.

The control unit 321 does not receive the input signal Sin when the field sequential display 300 is unused. If the control unit 321 does not receive the input signal Sin for a predetermined time period (for example, 30 seconds) (i.e., when the field sequential display 300 is in the color mode and the control unit 321 still doesn't receive the input signal Sin after a first period of time), it is determined that the field sequential display 300 has not been used for some time. In this case, the control unit 321 switches the field sequential display 300 into the monochrome mode and generates the control signal Sco1 to enable the power device 323 and disable the power device 322.

After that, if the field sequential display 300 is still unused after predetermined time period (for example, one minute) (i.e., when the field sequential display 300 is in the monochrome mode and the control unit 321 still doesn't receive the input signal Sin after a second period of time), the control unit 321 turns off the field sequential display 300 and generates the control signal Sco1 to disable the power devices 322 and 323. It should be mentioned that in the present embodiment, whether the field sequential display 300 is used is determined based on whether the input signal Sin is received. However, the present invention is not limited thereto.

Figure 4:
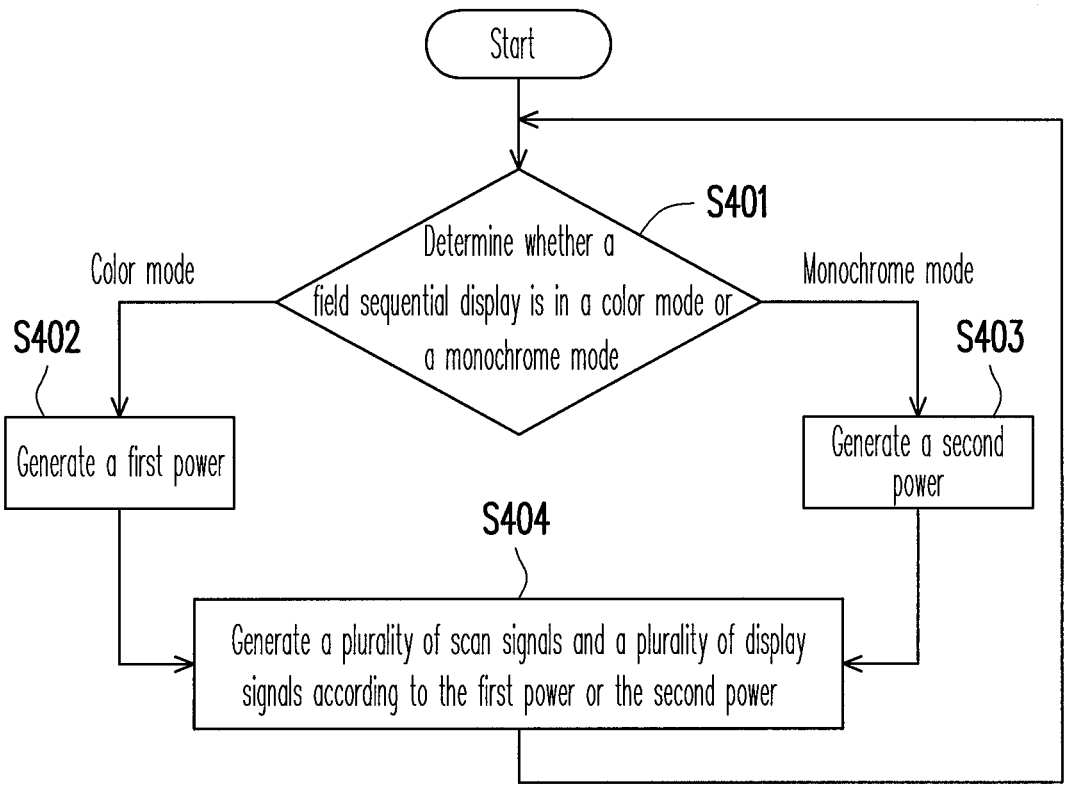
FIG. 4 is a flowchart of a driving method of a field sequential display according to an embodiment of the present invention.

A method for driving a field sequential display can be derived from the operations of the driver 320 described above. FIG. 4 is a flowchart of a driving method of a field sequential display according to an embodiment of the present invention. Referring to FIG. 4, in the first instance whether the field sequential display is in a color mode or a monochrome mode is determined (step S401). When the field sequential display is in the color mode, a first power is generated (step S402). Next, a plurality of scan signals and a plurality of display signals are generated according to the first power (step S404), so as to drive a display panel of the field sequential display. Contrarily, when the field sequential display is in the monochrome mode, a second power is generated (step S403). Next, a plurality of scan signals and a plurality of display signals are generated according to the second power, so as to drive the display panel of the field sequential display (step S404). The voltage and current of the second power are smaller than the voltage and current of the first power, and the details of foregoing steps can be referred to the description of foregoing embodiment therefore will not be described herein. In addition, after step S404, the process returns to step S401 to continuously determine the display mode of the field sequential display and generate a power according to the display mode, so as to reduce the power consumption of the field sequential display.

As described above, the present invention provides a driver of a field sequential display and a driving method thereof. According to the present invention, in a color mode, a power device supplies a power with a high voltage and a high current, and scan signals with high rising/falling rate and data signals with high maximum voltage are generated correspondingly. In a monochrome mode, another power device supplies a power with a low voltage and a low current, and scan signals with low rising/falling rate and data signals with low voltage are generated correspondingly. Thereby, the power consumption of the field sequential display is reduced in the monochrome mode.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driver of a field sequential display, comprising:

a first power device, for generating a first power when the field sequential display is in a color mode;

a second power device, for generating a second power when the field sequential display is in a monochrome mode, wherein a voltage and a current of the second power are smaller than a voltage and a current of the first power, wherein the first power device is enabled when the field sequential display is in the color mode, and the second power device is enabled when the field sequential display is in the monochrome mode, according to a control signal;

a driving waveform generator, coupled to the first power device and the second power device, for generating a plurality of scan signals and a plurality of display signals according to the first power or the second power, so as to drive a display panel of the field sequential display; and a control unit, wherein when the field sequential display is in the color mode and the control unit does not receive an input signal after a first period of time, the control unit switches the field sequential display into the monochrome mode and generates the control signal to enable the second power device, when the field sequential display is in the monochrome mode and the control unit does not receive the input signal after a second period of time, the control unit turns off the field sequential display and generates the control signal to disable the first power device and the second power device, and when the control unit receives the input signal, the control unit switches the field sequential display into the color mode and generates the control signal to enable the first power device.

2. The driver according to claim 1, wherein the control unit is a microcontroller.

3. The driver according to claim 1 further comprising:

a timing controller (TCON), coupled to the driving waveform generator, for providing a clock signal to the driving waveform generator.

4. The driver according to claim 3, wherein the driving waveform generator comprises:

a gate driver, coupled to the first power device, the second power device, and the TCON, for generating the scan signals according to the clock signal and the first power when the field sequential display is in the color mode, and for generating the scan signals according to the clock signal and the second power when the field sequential display is in the monochrome mode; and a source driver, coupled to the first power device, the second power device, and the TCON, for generating the display signals according to the clock signal and the first power when the field sequential display is in the color mode, and for generating the display signals according to the clock signal and the second power when the field sequential display is in the monochrome mode.

5. The driver according to claim 1, wherein the first power device and the second power device are respectively a power generator.

6. The driver according to claim 1, wherein the first power device and the second power device are respectively a power supply.

7. The driver according to claim 1, wherein the first power device is a voltage boost circuit, and the second power device is a charge pump circuit.

8. A driving method of a field sequential display, comprising:

determining whether the field sequential display is in a color mode or a monochrome mode;

generating a first power when the field sequential display is in the color mode;

generating a second power when the field sequential display is in the monochrome mode, wherein a voltage and a current of the second power are smaller than a voltage and a current of the first power; and generating a plurality of scan signals and a plurality of display signals according to the first power or the second power, so as to drive a display panel of the field sequential display;

wherein, the step of determining whether the field sequential display is in the color mode or the monochrome mode comprises:

determining that the field sequential display is in the color mode when an input signal is received;

determining that the field sequential display is in the monochrome mode when the field sequential display is in the color mode and the input signal is not received after a first period of time; and determining that the field sequential display is in an off state when the field sequential display is in the monochrome mode and the control unit does not receive the input signal after a second period of time.

9. The driving method according to claim 8, wherein the step of generating the scan signals and the display signals according to the first power or the second power comprises:

generating the scan signals and the display signals according to the first power and a clock signal when the field sequential display is in the color mode; and generating the scan signals and the display signals according to the second power and the clock signal when the field sequential display is in the monochrome mode.

* * * * *

UNITED STATES PATENT AND TRADEMARK OFFICE

CERTIFICATE OF CORRECTION

PATENT NO. : 8,643,683 B2
APPLICATION NO. : 12/824238
DATED : February 4, 2014
INVENTOR(S) : Pao-Shu Chang It is certified that error appears in the above-identified patent and that said Letters Patent is hereby corrected as shown below:

Title Page item (73) Assignee's Name

"Nuvoton Technolgoy Corporation" should be changed to -- Nuvoton Technology Corporation --.

Signed and Sealed this
Twenty-ninth Day of April, 2014

Michelle K. Lee

Michelle K. Lee
*Deputy Director of the United States Patent and Trademark Office*